United States Patent [19]

Thysen et al.

[11] Patent Number: 4,498,317

[45] Date of Patent: Feb. 12, 1985

[54] LAUNDRY HANDLING MACHINE, ROTATIONAL SPEED REDUCTION ARRANGEMENT AND RINSING DEVICE

[75] Inventors: Albert A. P. Thysen, Bilzen; Gilbert L. J. Timmermans, Tongeren, both of Belgium

[73] Assignee: ITT Industries, Inc., New York, N.Y.

[21] Appl. No.: 349,805

[22] Filed: Feb. 18, 1982

[51] Int. Cl.[3] ..... D06F 25/00; D06F 33/02; D06F 39/02

[52] U.S. Cl. ..... 68/12 R; 68/19.2; 68/20; 68/24; 68/207

[58] Field of Search ..... 68/19.2, 20, 12 R, 207, 68/24

[56] References Cited

U.S. PATENT DOCUMENTS

| | | | |
|---|---|---|---|
| 2,486,315 | 10/1949 | Morris | 68/20 X |
| 2,921,384 | 1/1960 | Smith | 68/19.2 X |
| 2,961,863 | 11/1960 | Sulcek | 68/20 |
| 3,098,726 | 7/1963 | Stone | 68/19.2 X |
| 3,323,336 | 6/1967 | Johnson et al. | 68/19.2 X |
| 3,410,116 | 11/1968 | Levinson | 68/20 X |

FOREIGN PATENT DOCUMENTS

| | | | |
|---|---|---|---|
| 1022966 | 12/1952 | France | 68/20 |

*Primary Examiner*—Philip R. Coe

*Attorney, Agent, or Firm*—John T. O'Halloran; Peter R. Ruzek; Mary C. Werner

[57] ABSTRACT

A laundry handling machine for performing both a washing operation and a drying operation includes a blower which directs air over the motor during both the washing and drying operations to cool the motor and additionally directs air over a heating element during the drying operation to provide heated air through the vat. A rotational speed reduction arrangement is provided for controlling the timing of both of the operations. A drying operation timing device is driven by the washing operation timing device. A rinsing device is coupled with a supply conduct for a rinsing liquid and also with a siphon drain tube which has a larger cross-section than the supply conduct.

39 Claims, 17 Drawing Figures

LAUNDRY HANDLING MACHINE, ROTATIONAL SPEED REDUCTION ARRANGEMENT AND RINSING DEVICE

The present invention relates to a laundry handling machine able to perform a washing operation and a drying operation and including a vat, a laundry stirring member mounted in said vat, a cover housing driving and control means which include a blower and a motor driving said stirring member during both said washing and drying operations and driving said blower at least during said drying operation wherein heated air is blown through said vat.

Such a laundry handling machine is already known from Belgian Pat. No. 867 508 (W. KNUTH—K. TÄSCHNER 16-2). In this known machine means are provided to disconnect the blower from the motor during a washing operation in order to decrease to some extent the relatively high power then consumed by this motor and diminish the heat developed in the cover. Indeed, this power is higher during a washing operation than during a drying operation. But notwithstanding this measure the heat developed in the cover remains considerable and adversely affects the condition of the motor and of the various other components of the driving and control means mounted in this cover.

It is therefore a first object of the present invention to provide a laundry handling machine wherein less heat is developed in the cover and which does not require the use of blower connection/disconnection means.

According to the invention this object is achieved due to the fact that said blower is driven by said motor during both said washing and drying operations in order to then cool said motor.

In this way the motor is continuously cooled and because the blower remains coupled to the motor no connection/disconnection means are required between the motor and the blower.

Another characteristic feature of the present laundry handling machine is that said blower has an outlet and is able to simultaneously produce two separate air streams, a first of said air streams flowing over said motor and a second of said air streams flowing over a heatable member, and to expell both said air streams simultaneously through said outlet into the atmosphere either directly during a washing operation or via said vat during a drying operation.

Thus the motor cannot be adversely influenced by the second air stream which is heated during a drying operation.

Still another characteristic feature of the present laundry handling machine is that it includes flow rate regulating means to make the flow rate of both said air streams flowing through said outlet smaller during said washing operation than during said drying operation.

Due to the decreased flow rate of the air stream during a washing operation the motor then consumes less power to drive the blower, without means being required to uncouple the blower from the motor.

The present invention also relates to a rotational speed reduction arrangement for reducing the rotational speed of a rotatable driving member, said arrangement including a speed reduction device comprising a one-way clutch mechanism, with a rotatable input member and a rotatable output member, and a restoring member, said rotatable driving member when making a predetermined rotation in a predetermined direction communicating to said input member an angular displacement from an initial position over a fraction of said predetermined rotation and in an opposite direction, said output member being thereby angularly displaced in said opposite direction by said input member, and said restoring member being then able to rotate said input member back into said initial position, said output member thereby remaining in the position previously attained.

Such an arrangement is already known from Belgian Pat. No. 858,672 corresponding to U.S. Pat. No. 4,218,898 (L. BOYEN-R. D'HUYS). Therein the output member has a rotational speed which is considerably smaller than that of the driving member and is used for timing the duration of a washing operation.

Another object of the present invention is to provide an arrangement of the above type but having an output member with a further reduced speed of operation.

According to the invention this object is achieved due to the fact that it includes a second said speed reduction device comprising a second one-way clutch mechanism, with a second input member and a second output member, and a second restoring member, said second input member being driven from said output member of said first speed reduction device. Thus the second output member has a considerable smaller rotational speed than the rotatable driving member.

The present invention also relates to a laundry handling machine including a washing operation timing device and a drying operation timing device.

Such a laundry handling machine is known from the above mentioned Belgian Pat. No. 867 508 (W. KNUTH—K. TÄSCHNER 16-2). Therein both timing devices are constituted by individual units adapted to individually time the full washing and drying operations respectively.

An object of the present invention is to provide a laundry handling machine of the above type but wherein the timing can be performed in a more economic way.

According to the invention this object is achieved due to the fact that said drying operation timing device is driven through said washing operation timing device.

In this way the washing operation timing device can be used either for timing a washing operation or in cooperation with the drying operation timing device for timing a drying operation.

The present invention further also relates to a laundry handling machine with a vat, a cover for said vat, and driving and control means for said machine, said vat having a front washing compartment separated from a rear part by a partition wall and said cover comprising a front lid giving access to said washing compartment and a rear casing housing at least part of said means.

Such a laundry handling machine is well known in the art, e.g., from U.S. Pat. No. 3,046,543. In this known machine a substantial part of the casing of the cover is located above the washing compartment of the vat so that the driving and control means located in this casing as well as the casing itself are subjected to the heat developed in the washing compartment during a washing operation.

Still another object of the present invention is to provide a laundry handling machine of the above type but which avoids such an effect thereby facilitating manufacture and/or reducing wear.

According to the invention this object is achieved due to the fact that the plane of said partition wall separates said washing compartment from said casing.

In this way the casing of the cover as well as the driving and control means housed therein are mounted behind the washing compartment of the vat and cannot be significantly affected by the heat developed therein during a washing operation.

The present invention also relates to a rinsing device for a vat and more particularly to a rinsing device for the vat of a laundry handling machine.

A characteristic feature of the present rinsing device is that said vat is coupled on the one hand with a supply conduct for a rinsing liquid and on the other hand with a siphon drain tube which has a larger cross-section than said supply conduct.

In this way, when the vat is filled with a rinsing liquid via the supply conduct this liquid rises in the vat until the siphon action starts, as a consequence of which the vat is emptied via the siphon drain tube more rapidly than it is filled again via the supply conduct. This operation is repeated as long as fresh rinsing liquid is supplied to the vat via the supply conduct.

The above mentioned and other objects and features of the invention will become more apparent and the invention itself will be best understood by referring to the following description of an embodiment taken in conjunction with the accompanying drawings in which.

Figure 1:
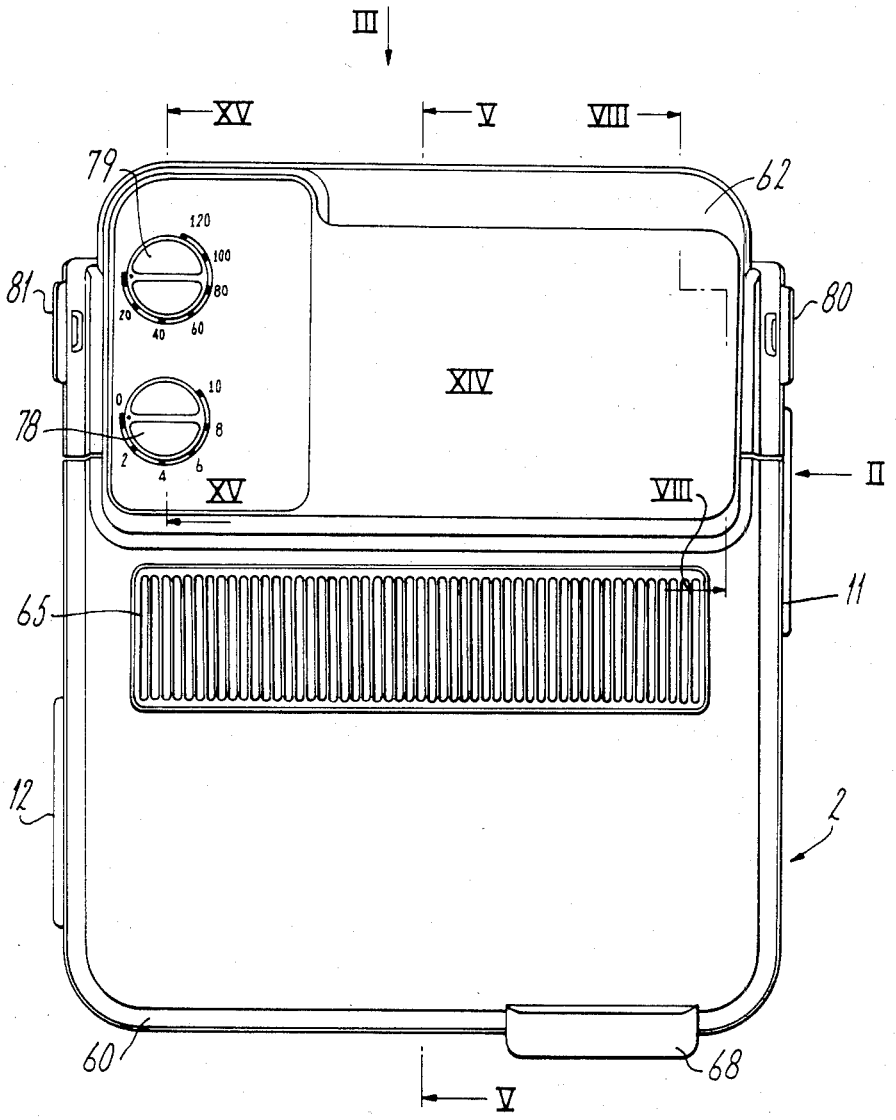
FIG. 1 is a top view of a laundry handling machine according to the invention.
Figure 3:
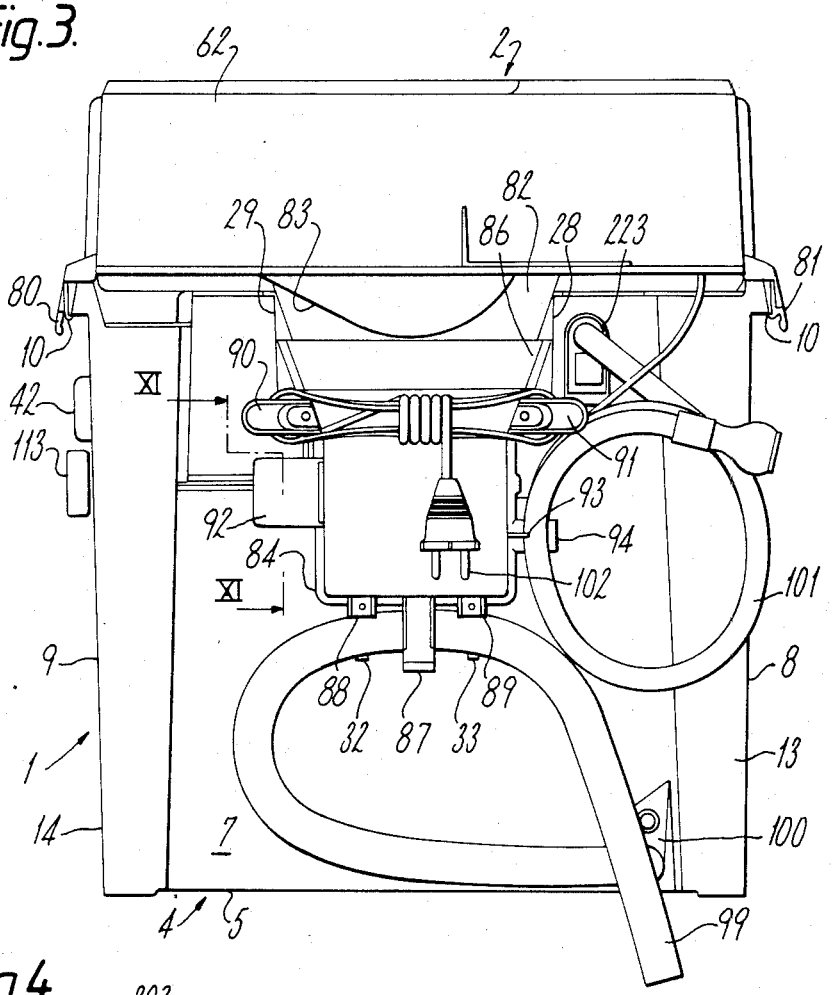
FIG. 3 is a rear view of this machine in the direction of arrow III of FIG. 1.
Figure 4:
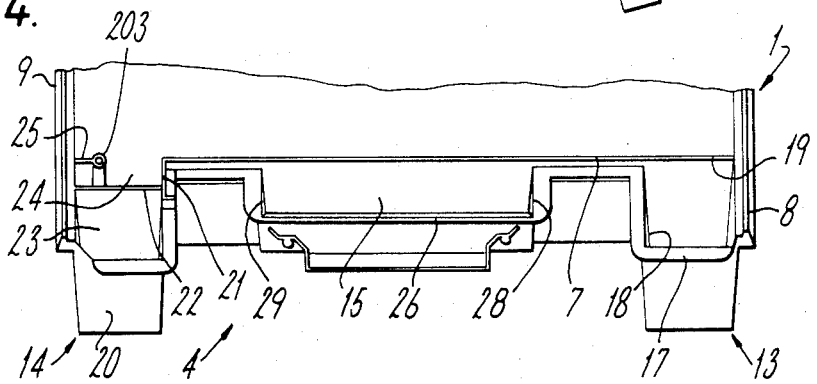
FIG. 4 is a perspective top view of the rear part of the vat of this machine.
Figure 5:
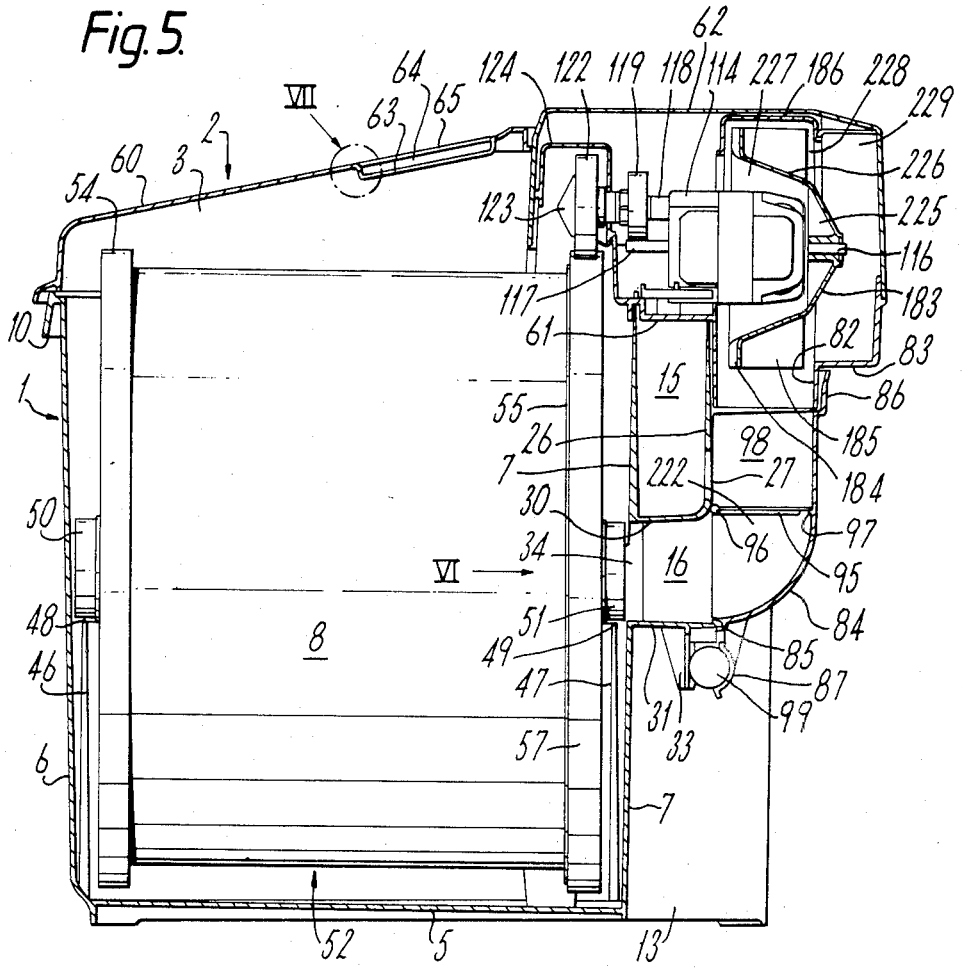
FIG. 5 is a cross-sectional side view along line V—V in FIGS. 1 and 14 and at the scale of FIG. 1, however, with some parts removed.

The laundry handling machine shown includes a vat 1 which has an open top and which is closed by a cover 2. Vat 1 comprises a front washing compartment 3 (FIG. 5) and a rear part or supporting structure 4. The washing compartment 3 is delimited by a bottom wall 5, a front wall 6, a rear wall 7 and side walls 8 and 9, the upper edge of all these walls being located in a same plane parallel to the bottom wall 5. The walls 6, 8 and 9 have a downwardly inclined rim 10 and the side walls 8 and 9 are provided with handgrips 11 and 12 (FIG. 1). The supporting structure 4 comprises two lateral downwardly tapering hollow columns 13 and 14, a central box-shaped vertical air channel 15 and a central air conduct 16 disposed below the air channel 15. Hollow column 13 (FIG. 4) is delimited by portions of rear wall 7 and side wall 8 and by two further walls 17 and 18 which have a height smaller than that of these wall portions and which are parallel thereto. Hollow column 13 is fully separated from the washing compartment 3 by portion 19 of rear wall 7. Likewise hollow column 14 is delimited by portions of rear wall 7 and side wall 9 and by two further walls 20 and 21 which have a height smaller than that of these wall portions and which are parallel thereto. Hollow column 14 is subdivided by a partition wall 22 into a closed compartment 23 and a float compartment 24 the partition wall 22 being parallel to rear wall 7 and having the same height as this rear wall 7. The float compartment 24 communicates with the front washing compartment 3 as the rear wall 7 is interrupted at a certain distance from the side wall 9 where there only remains a small strip 25. The central air channel 15 has an open top and comprises a rear wall 26, disposed at a distance from the vat rear wall 7 and provided with an opening 27, side walls 28 and 29 (FIG. 3) and bottom wall 30 (FIG. 5). The latter bottom wall 30 forms the top wall of the adjacent air conduct 16 which has moreover side walls (not shown) and a bottom wall 31 provided with two downwardly directed fingers 32 and 33 (FIG. 3). Air conduct 16 communicates with the washing compartment 3 through opening 34 which has an area equal to about three times that of opening 27.

Figure 2:
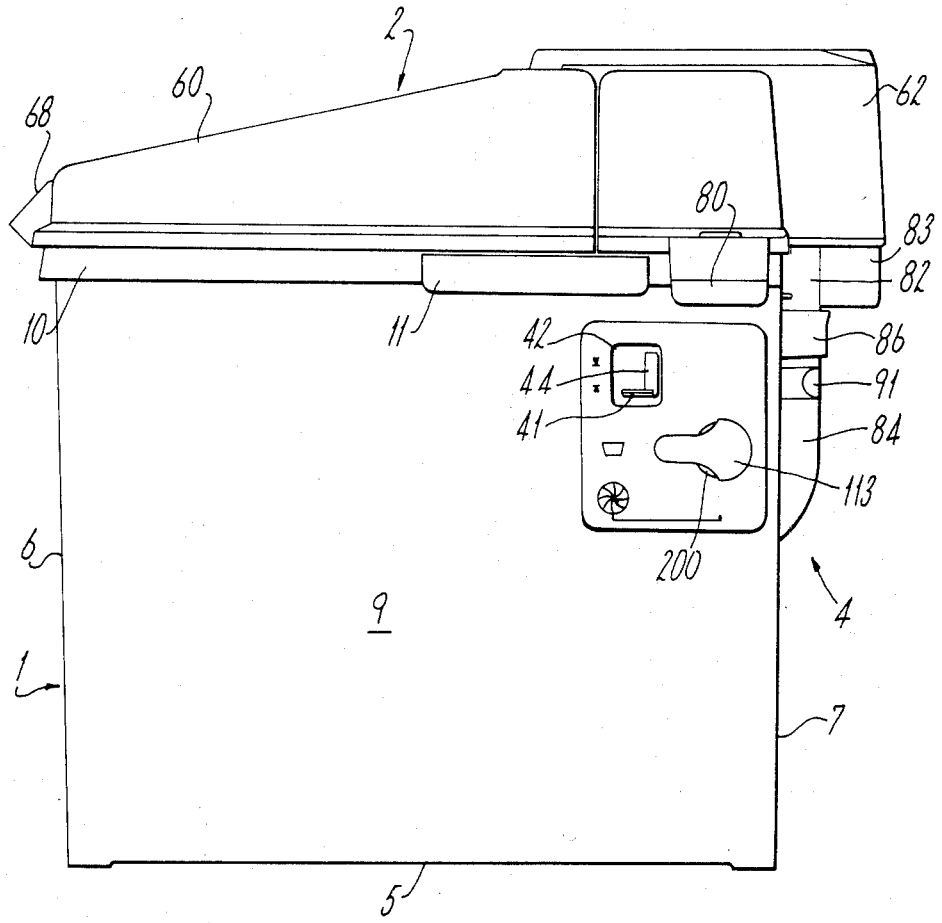
FIG. 2 is a side view of this machine in the direction of arrow II of FIG. 1.

The hollow float compartment 24 (FIGS. 8, 9) houses a float 35 comprising a block of polystyrene foam 36 press fitted into a U-shaped holder 37 which is integral with an upstanding rod 38. At its upper end the latter rod 38 is bent at 90° so as to form a portion 39 which extends through an opening 40 in the vat side wall 9, the latter portion 39 being again bent at 90° so as to form a horizontal level indicating finger 41 (FIG. 2) located outside vat 1 and parallel to side wall 9. This finger 41 is visible from the outside through a removable window 42 clipped in an opening 43 in vat wall 9 and in part 44 (FIG. 2) of opening 40. Vat wall 9 is also provided with an overflow opening 45 (FIG. 8) to permit the evacuation of e.g. foam out of the float compartment 24.

Figure 6:
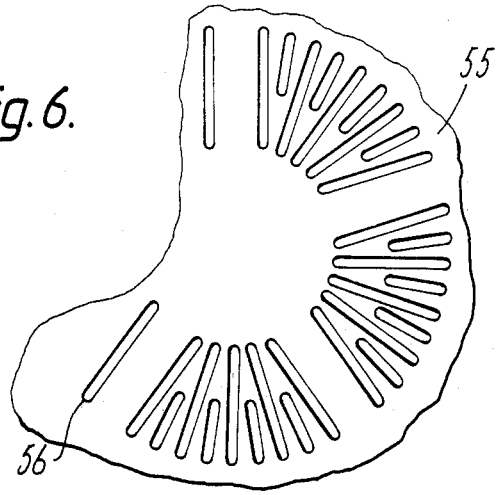
FIG. 6 is a side view in the direction of arrow VI of part of the drum of the machine of FIG. 5.
Figure 13:
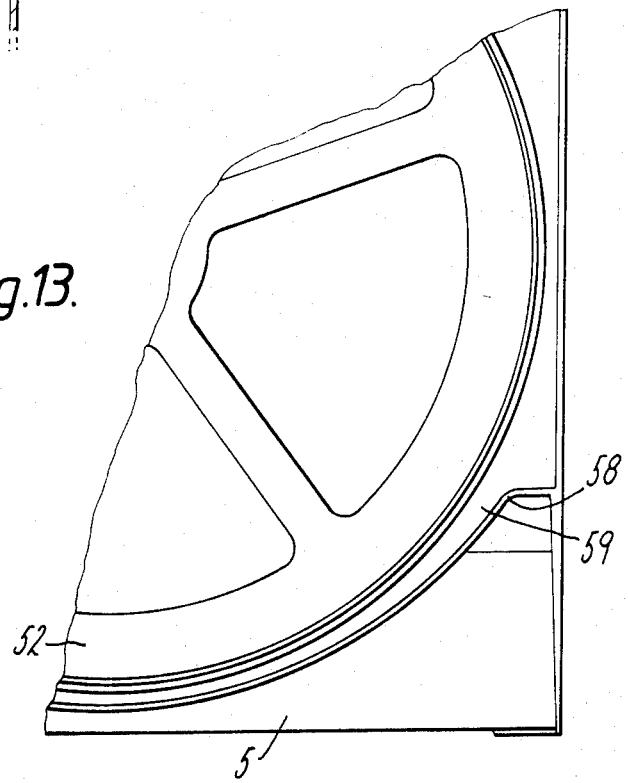
FIG. 13 is a cross-sectional side view at an enlarged scale through part of the vat bottom and drum of the machine of FIG. 1.

Inside the washing compartment 3 front wall 6 and rear wall 7 are provided with upstanding ribs 46, 47 (FIG. 5) on which semi-circular bearings 48 and 49 are fixed respectively. These bearings 48 and 49 rotatably support cylindrical axle portions 50 and 51 of a laundry stirring member constituted by a washing drum 52. This drum 52 which is only schematically represented but which is substantially similar to the one used in the above mentioned laundry handling machine (Belgian Pat. No. 858 672) comprises a cylindrical casing 53 and two circular side walls 54 and 55, side wall 55 having a plurality of radial slots 56 of constant width (FIG. 6). Drum 52 may be driven due to the peripheral part of its side wall 55 being provided with a toothed ring 57, as will be explained later. As shown in FIG. 13 the bottom 58 of the washing compartment 3 is constituted by part of a cylinder and the lower part of the cylindrical drum 52 is mounted at a distance from this cylindrical bottom 58. The drum 52 has a smaller radius than this bottom 58, the axes of the drum and of the bottom being parallel and located in a same vertical plane. Thus there is formed between drum 52 and bottom 58 a free space 59 the cross-section of which gradually increases from the middle of the bottom of the washing compartment 3 to the side walls 6 and 7 thereof. This has been done in order to prevent the rotation of the drum 52 from being hindered by objects such as buttons which have been separated from the laundry and brought in the free space 59.

Figure 9:
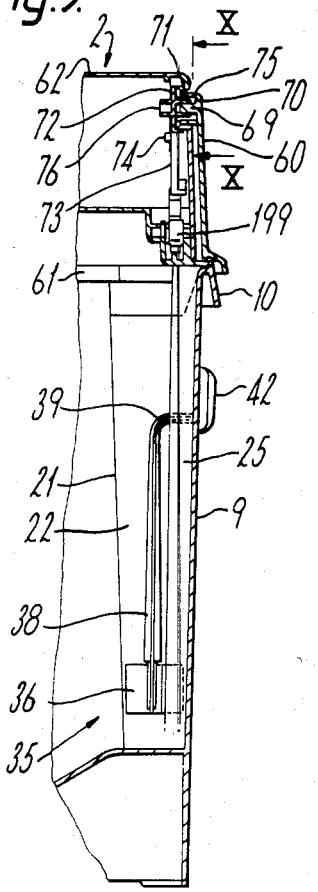
FIG. 9 is a cross-sectional view along line IX—IX in FIG. 8.
Figure 10:
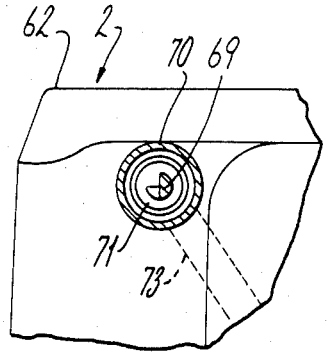
FIG. 10 is a cross-sectional side view along line X—X in FIG. 9 but at an enlarged scale.

The above mentioned cover 2 comprises a front lid 60 covering the washing compartment 3 and a rear casing 61, 62 supported by the rear supporting structure 4 and more particularly by the columns 13 and 14 and the air channel 15 thereof. The casing comprises a mounting plate 61 (FIG. 5) and a cap 62 to which the front lid 60 is hinged in a way shown in FIGS. 9 and 10 and to be described later. The mounting plate 61 only covers a central portion of the open top of the air channel 15, and lateral portions (not shown) of this top communicate with the atmosphere.

Figure 7:
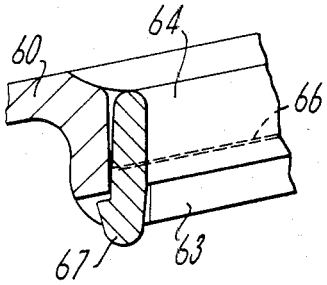
FIG. 7 is a detailed cross-sectional view at an enlarged scale of part VII of FIG. 5.
Figure 8:
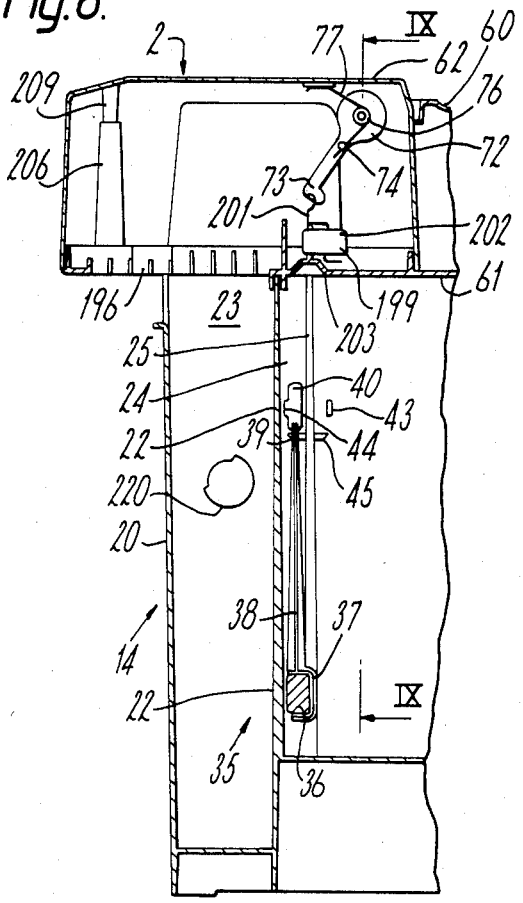
FIG. 8 is a cross-sectional side view along line VIII—VIII in FIGS. 1 and 14 after some parts have been removed and at the scale of FIG. 1.

Front lid 60 is provided with an opening 63 into which a filter element 64 comprising a grid 65 and a piece of filter paper 66 is clipped by clips such as 67 (FIG. 7). It is also provided with a handgrip 68 (FIG. 1) on its forward end and both its relatively resilient side walls are hingedly connected to the cap 62. One of these side walls is provided with a cylindrical protrusion (not shown) engaged in a blind hole (not shown) of the cap 62. The other side wall is provided at its inner side with a pivot pin 69 surrounded by a cylindrical portion 70 and rotatably engaged in a blind hole of a cylindrical stud 71 provided in the center of a cup-shaped circular end 72 of a lever arm 73. This arm 73 has a substantially U-shaped cross-section and is provided with a lateral protrusion 74. The stud 71 is rotatably engaged in an opening of the last mentioned other lateral wall of the cap 62, this opening being delimited by a moisture ingress preventing lip 75 located between the cylindrical stud 71 and the annular portion 70, on the one hand, and between this annular portion 70 and the outer flange of the cup-shaped end 72 of the lever arm 73 on the other hand. The cup-shaped end 72 of lever arm 73 is also provided with a further cylindrical stud 76 around which a wire spring 77 is mounted in such a way that the ends thereof make contact with the top wall of the cap 62 and with the lateral protrusion 74 on the arm 73 respectively. This spring 77 continuously urges the lever arm 73 in clockwise direction (FIG. 8). The latter lever arm 73 forms part of a security device which will be described later. The cross-sections of the pivot pin 69 and of the blind hole in the cylindrical stud 71 are not fully complementary (FIG. 10) so that the lever arm 73 is only rotated together with the lid 60 after the latter has been rotated over a certain angle. It should be noted that in case lid 60 has been removed the spring 77 pivots lever arm 73 into contact with the adjacent side wall of the cap 62 (FIG. 8).

The top wall of cap 62 is provided with two openings through which selection knobs 78 and 79 (FIG. 1) protrude. Knob 78 is a washing programme selection knob permitting the selection of the duration of a washing operation and knob 79 is a drying programme selection knob enabling the selection of the duration of a drying operation. Cap 62 is further laterally provided with slightly resilient flaps 80 and 81 (FIG. 1) which cooperate with the peripheral rim 10 of the vat 1 to fix the cap 62 thereon.

Figure 14:
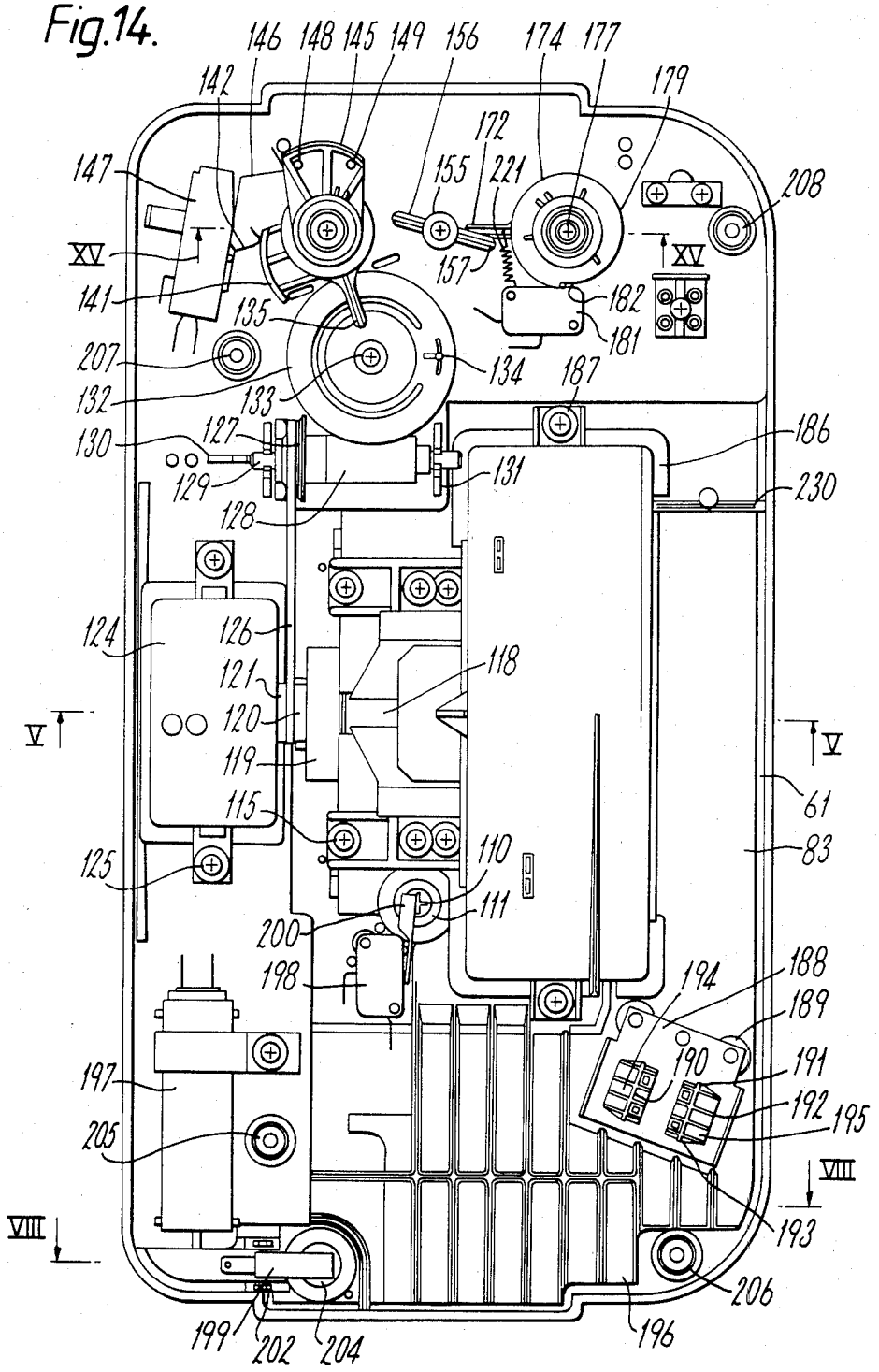
FIG. 14 is a top view at an enlarged scale of part XIV of FIG. 1 after the cover of the machine has been removed.

The above mentioned mounted plate 61 is partly supported by upper edges of wall 7, hollow columns 13, 14 and air channel 15 and its non supported portion is provided with a plurality of air inlet openings 196 (FIG. 14) some of which are located above column 13. At its rear side the mounting plate 61 on the one hand has a downwardly tapering part 82 (FIGS. 3, 5) which is open at its lower end and on the other hand has an adjacent part 83 which has a shape clearly shown in FIG. 3 and which is delimited at one side by a substantially vertical wall 230 (FIG. 14). The latter part 83 forms with the adjacent part of the casing 61 an air inlet space 229 (FIG. 5).

The mounting plate 61 is secured to the vat 1 by means of a rear cover member 84 (FIGS. 3, 5) and a sealing member 85 is used to ensure water thightness. This rear cover member 84 has an upper collar 86, a lower central retaining clip 87, two lower lips 88 and 89, two lateral ears 90 and 91, a lateral housing 92 and a lateral substantially U-shaped attachment member 93–94 with lips 93 and 94. The cover member 84 carries a manually rotatable bistable shutter member 95 (FIG. 5) fixed on a pivot axle 96 and normally resting with its edge on an inner lip 97 and closing an opening 222. The upper collar 86 of the cover member 84 fits on the lower end of tapering part 82 of the mounting plate 61 and forms with the rear wall 26 of the air channel 15 an outlet pipe 98 able to communicate either with the air channel 15 via opening 27 or with the washing compartment 3 via opening 222, air conduct 16 and opening 34, depending on the position of shutter member 95. The cover member 84 is fixed on the vat 1 by means of screws screwed in the lips 88 and 89 and in the ears 80 and 91. The inlet of a siphon drain tube 99 (FIG. 3) is fixed on the vat at 100 close to the bottom thereof and in operation its outlet is located below its inlet, as shown in FIG. 3. The tube 99 is engaged between the fingers 33 and 34 on the one side and the retaining clip 87 on the other side. A water supply conduct 101 is fixed to the vat 1 at 223 and is engaged between the lips 93 and 94 of the attachment member 93–94. The diameter of drain tube 99 is larger, e.g. two times, than that of supply conduct 101. At a certain distance below conduct 101 the vat has an overflow opening (not shown). The ears 90 and 91 serve for winding up an electricity supply cable 102.

Figure 11:
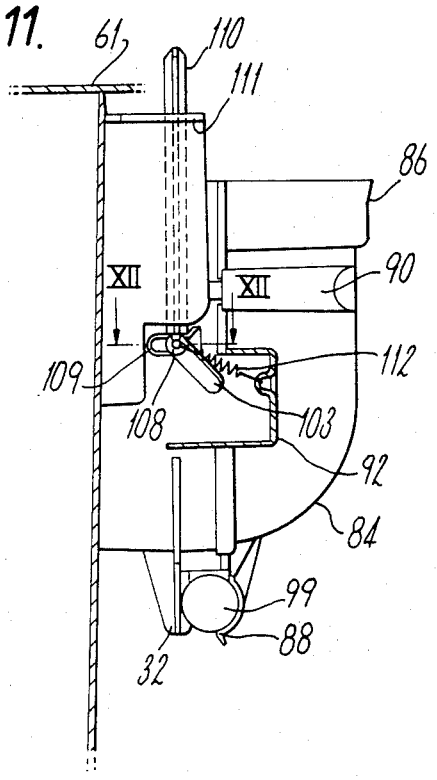
FIG. 11 is a cross-sectional side view along line XI—XI in FIG. 3 but at an enlarged scale.
Figure 12:
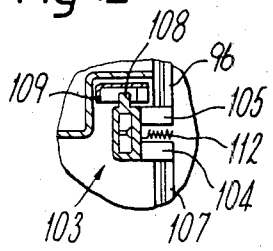
FIG. 12 is a cross-sectional view along line XII—XII in FIG. 11.

The lateral housing 92 (FIGS. 3, 11) of the cover member 84 houses a U-shaped lever 103 with lateral arms 104 and 105 and a transverse arm 106. An axle 107 and the above axle 96 are integral with the free ends of the arms 104 and 105 respectively and are located in the prolongation of each other. Arm 105 is provided with a lateral protrusion 108 engaged in the channel of a substantially U-shaped guide piece 109 which is integral with the lower end of a control rod 110 protruding through an opening 111 in the mounting plate 61. The transverse arm 106 of the U-shaped lever 103 is attached to a wall of housing 92 by means of a spring 112. At its one end the axle 96 carries the above shutter member 95 mounted in the outlet pipe 98. At its other end protruding through an opening 220 in the side wall 9 of the vat the axle 96 carries a rotatable dry/wash selection knob 113. This knob 113 is used to bring the shutter member 95 against the action of spring 112 either in a horizontal or in a vertical stable position wherein the outlet pipe 98 communicates with the air channel 15 or with the air conduct 16 respectively.

Figure 15:
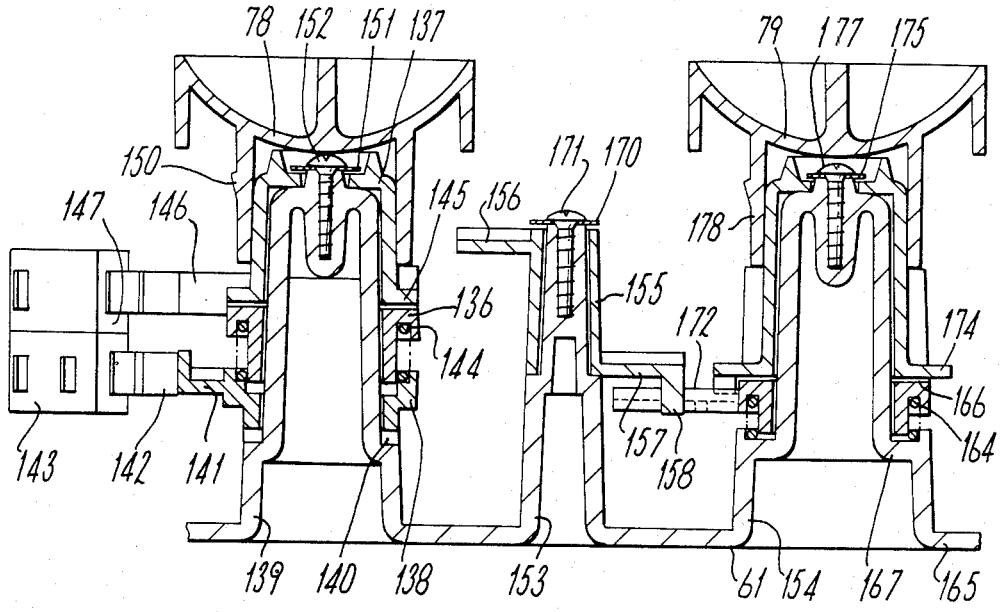
FIG. 15 is a cross-sectional side view along line XV—XV in FIGS. 1 and 14 at an enlarged scale.

A driving and control device for the machine is mounted on the mounting plate 61 for driving the washing drum 52 and for controlling a washing operation timing mechanism, of the type disclosed in the above mentioned Belgian Pat. No. 858 672, corresponding to U.S. Pat. No. 4,218,898, and a drying operation timing mechanism. These mechanisms are intercoupled by a rotation reversal device and are driven by a same motor 114 the direction of rotation of which is alternately reversed. This motor 114 has a frame which is fixed on plate 61 by screws such as 115, and a horizontal drive shaft 116–117 (FIG. 5) which protrudes at both sides of the motor. A blower generally indicated by reference numeral 183 is directly fixed on the one end 116 of this drive shaft 116–117 the other end 117 of which is constituted by a worm. The motor frame is further provided with a fixed axle stud 118 (FIGS. 5, 14) which extends in parallel to the worm 117 which engages with a worm wheel 119 rotatably mounted on the fixed axle stud 118 and having a hub 120. The latter hub 120 is united by axial pressure to the hub 121 of a drive wheel 122 which is also rotatably mounted on the axle stud 118 and which engages with the toothed ring 57 of the drum 52 the axis of which is parallel to drive shaft 116–117. Both this axis and shaft are substantially located in a same vertical plane. At its end away from the worm wheel 119 a cap 123 is secured to the axle stud 118. The hub 121 of the drive wheel 122 fits into an opening of a skirt 124 fixed on plate 61 by means of screws such as 125. A toothed drive belt 126 is arranged around the hub 120 of the worm wheel 119 and in the peripheral groove of a pulley 127 which is integral with a worm 128, both the pulley 127 and the worm 122 being rotatably mounted about a horizontal axle 129 fixed in supports 130 and 131 formed on the mounting plate 61. This worm 128 engages with a worm wheel 132 which is rotatably mounted around a vertical axle 133 and which forms part of the above mentioned washing operation timing mechanism. This wheel 132 which simultaneously forms a driving member and a restoring member bears a vertical stud 134 adapted to cooperate with a radial control arm 135 of a lower clutch member or input member 136 of a one-way clutch mechanism (FIGS. 14, 15) which further comprises an upper clutch member or output member 117. Both the clutch members 136 and 137 and a motor rotation reversal control member 138 are fixed on a vertical frusto-conical peg 139 formed on the mounting plate 61. This vertical peg 139 has a lower portion with a larger diameter than its upper part and thus delimits a peripheral shoulder supporting an annular friction ring 140. The control member 138 which rests on the friction ring 140 has a lateral cam member 141 with a radius variable over an angle of about 60° and controls the movable armature 142 of a microswitch 143. The control member 138 also has an upper surface with an annular groove housing the bottom part of a coiled spring 144. The upper part of this spring is located in a similar annular groove in the bottom part of lower clutch member 136. The bottom part of this lower clutch member 136 is provided with protrusions (not shwon) fitting in recesses (also not shown) of the control member 138. On its upper side the lower clutch member 136 is provided with teeth (not shown) which cooperate with regularly spaced teeth (also not shown) on the underside of the ring-shaped base of the upper clutch member 137. This ring-shaped base is also provided with a lateral cam member 145 having a radius variable over an angle of about 60° and controlling the timing of a washing operation through the intermediary of the movable armature 146 of a change-over contact of a microswitch 147 mounted on top of microswitch 143. This cam member 145 also carries two control pins 148 and 149. The upper clutch member 137 further has a dome-shaped upper portion on which the hollow cylindrical stem 150 of the washing programme selection knob 78 is engaged. This dome portion is fixed on the vertical peg 139 by means of washer 151 and screw 152.

As described in the above mentioned Belgian Pat. No. 858 672, when the rotatable driving member 132 which alternately rotates in two directions makes a full rotation in anticlockwise direction (FIG. 14) it communicates to the lower clutch member 136 an angular displacement from an initial or rest position over a fraction of this full rotation and in an opposite direction. Thereby the upper clutch member 137 is angularly displaced in this opposite direction by the lower clutch member 136. Afterwards when the driving member 132 makes a full rotation in the opposite direction it rotates the lower clutch member 136 back into its initial position. Thereby the upper clutch member 137 however remains in the position previously attained due to friction.

From the above it follows that the washing operation timing mechanism includes a speed reduction device, mainly including elements 132, 136, 137, which reduces the rotational speed of the driving member 132 and the output member 137 of which controls change-over contact 146.

Figure 16:
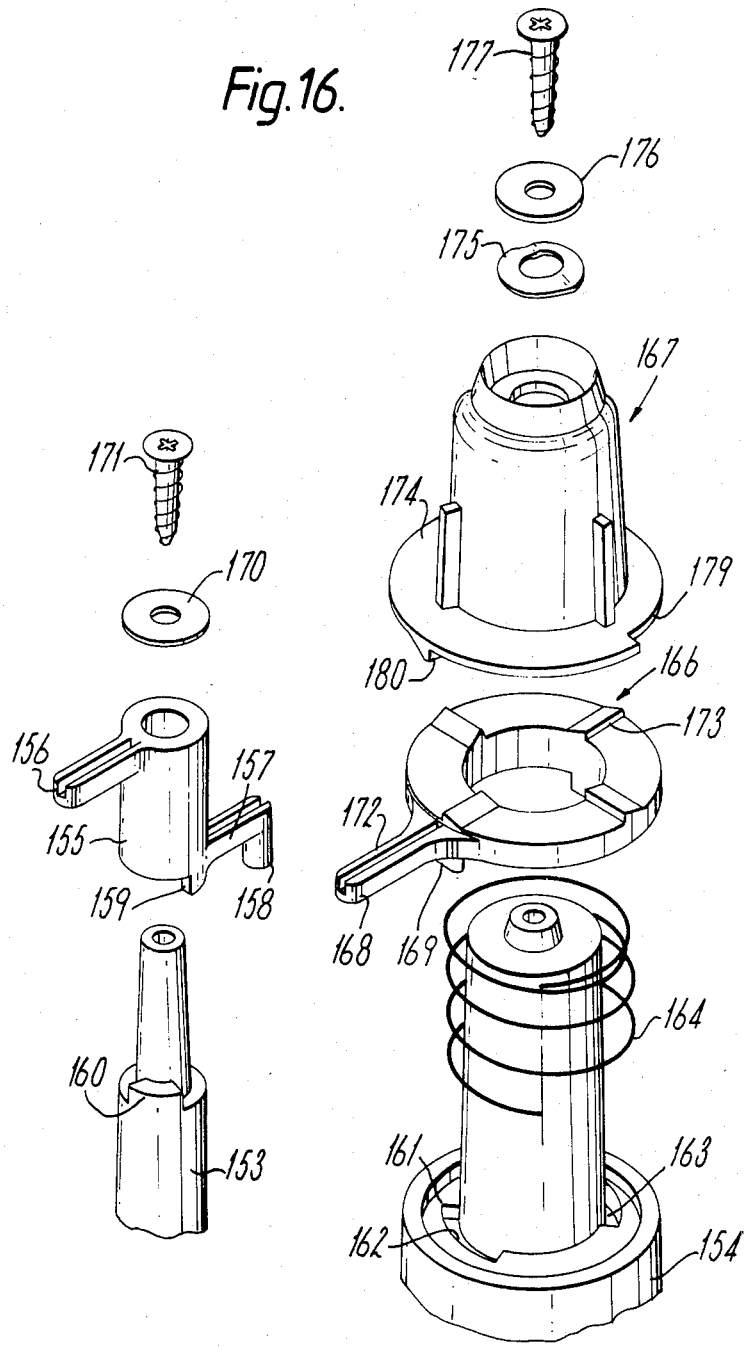
FIG. 16 is a perspective exploded view of parts of FIG. 15 at a different scale.

The above mentioned rotation reversal device (FIGS. 14, 15, 16) includes a frusto-conical peg 153 formed on the mounting plate 61. The peg 153 has a lower portion with a larger diameter than its upper part and thus delimits a peripheral shoulder which supports a frusto-conical rotation reversal member 155 fixed on the peg 153 by means of a washer 170 and a screw 171. The member 155 has an upper lateral arm 156 and a lower lateral arm 157 with a downward lip 158. On its bottom side the rotation reversal member 155 has a finger 159 able to cooperate with an abutment 160 on the lower part of the peg 153.

The above mentioned drying operation timing mechanism includes a vertical peg 154 formed on the mounting plate 61. This peg 154 has a lower portion with a larger diameter than its upper part and thus also delimits a peripheral shoulder. This shoulder has an outer annular groove 161 and two inner arcuate recesses 162 and 163 which are concentric with and are deeper than the annular groove 161. The latter groove 161 houses the bottom end of a coiled spring 164 the upper end of which is located in a similar groove 165 in the bottom part of a lower clutch member or input member 166 of a clutch mechanism which is similar to the above described one and which further comprises an upper clutch member or output member 167. The spring 164 tends to prevent a rotation of the lower clutch member 166 which is similar to the lower clutch member 136 and is likewise provided with a control arm 172 having a longitudinal groove 168. On its bottom side the lower clutch member 166 is provided with two opposite protrusions of which only one i.e. 169 is visible on FIG. 16 and which fits in the above mentioned recesses 162 and 163 respectively. On its upper side the lower clutch member 166 is provided with four teeth such as 173 at 90° interval which cooperate with 24 regularly spaced teeth (not shown) on the underside of the base 174 of the upper clutch member 167 which is fixed on the peg 154 by means of spring washer 175, washer 176 and screw 177 tending to prevent a rotation of the member 167. The stem 178 of the drying programme selection knob 79 is slid on this upper clutch member 167. The teeth of the lower clutch member 166 are disposed on an inner ring portion of the underside of the base 174 the periphery of which is shaped so as to form a cam 179 which controls the timing of a drying operation through the intermediary of the make contact 182 of microswitch 181. A further tooth 180 which is much larger than the first mentioned ones is provided on an outer ring portion of the underside of the base 174. This tooth 180 is normally engaged in the groove 168 of the control arm 172 which is connected to the body of the microswitch 181 by means of a coiled spring 221 which constitutes a restoring member.

The above mentioned blower 183 (FIG. 5) which is directly mounted on one end 116 of drive shaft 116–117 is located in a housing 186 which is open at both sides and the lower end of which communicates with the tapering outlet 82 of the mounting plate 61. The blower 183 comprises a cup-shaped wheel 226 provided at its periphery with radial vanes 184 and 185 and at its bottom with vanes 225. The surface of the vanes 185 is much larger than that of the vanes 184. This wheel subdivides the housing 186 into a first part 227 which encloses part of the motor 114 and which contains the vanes 184 and 225 and into a second part 228 which contains the vanes 185 and communicates laterally with the above mentioned air inlet space 229.

A vertical small frame structure 188 (FIG. 14) is fixed on cylindrical studs such as 189 of the mounting plate 61 close to the air inlet space 229. This structure 188 includes two plates 190 and 191 which carry a heatable member constituted by an electric resistance 192 connected in series with a thermo-limiter 193. These plates 190 and 191 extend through cooling apertures 194 and 195 of the structure 188. The mounting plate 61 which is provided with the air inlet openings 196 carries a capacitor 197 and microswitches 198 and 199. Microswitch 198 is provided with a make contact 200 controlled by rod 110 (FIG. 14) the vertical position of which is itself dependent on the angular position of the wash/dry selection knob 113, as already explained above. Microswitch 199 (FIGS. 8, 9) together with lever arm 73 form the above mentioned security device. This switch 199 is provided with a security make contact 201 and rests on a raised part 204 of the mounting plate 61. The latter plate 61 is also provided with a plurality of vertical stems 205, 206, 207 and 208 for supporting corresponding studs such as 209 (FIG. 8) on the cap 62.

The above mentioned electric motor 114 (FIG. 17) has two windings 210 and 211 which are connected at their one ends to the mains 212 shunted by capacitor 197 and at their other ends to a capacitor 213. These other ends are further individually connected via protecting resistors 214 and 215 to stationary contact members 216 and 217 which together with the above mentioned movable armature 142 forms the changeover contact of microswitch 142. This movable armature 142 is connected to the movable armature 146 which together with stationary contact members 218 and 219 forms the change-over contact of microswitch 147 controlled by the washing programme selection knob 78. The stationary contact member 219 is connected to one terminal of the mains 212 via the security make contact 201 of microswitch 199 and the stationary contact member 218 is connected to the same terminal via the series connection of make contact 200 of microswitch 198 controlled by the wash/dry programme selection knob 113, make contact 182 of microswitch 181 controlled by the drying programme selection knob 79, and the security make contact 201 of microswitch 199. The stationary contact member 218 is also connected to the other terminal of the mains 212 via the heating resistance 192 and the thermo-limiter 193.

Figure 17:
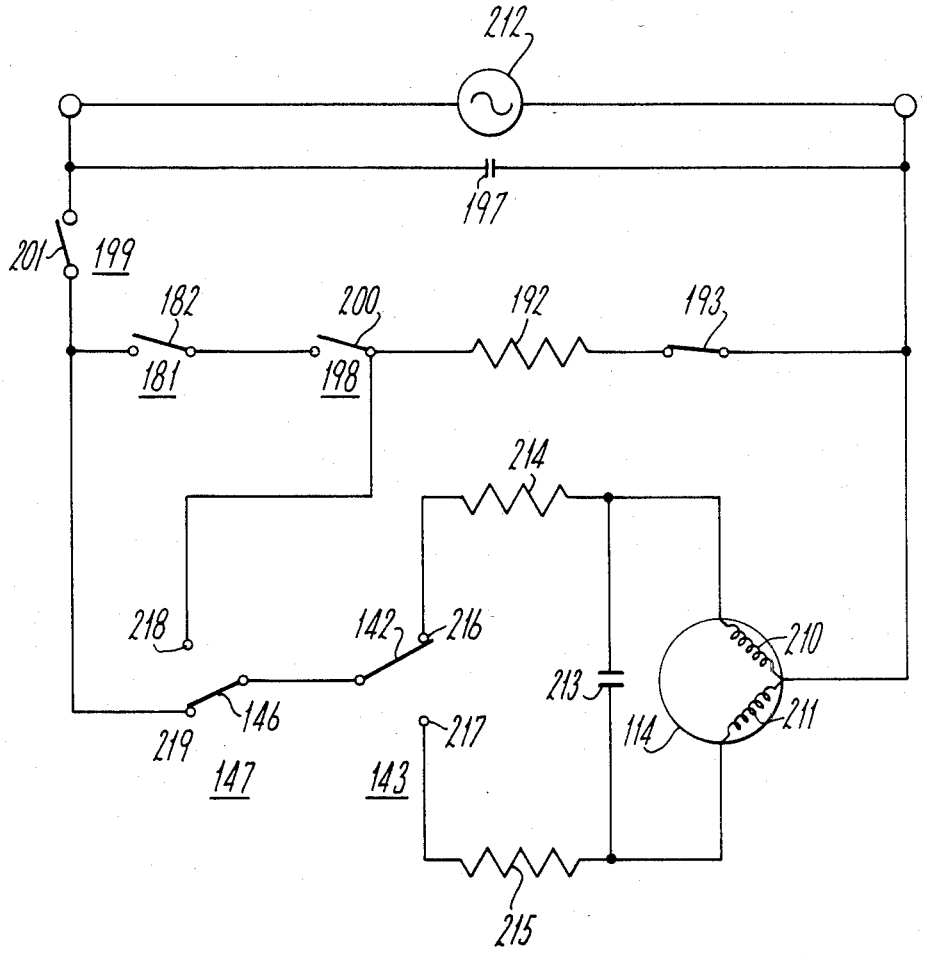
FIG. 17 is a schematic view of an electric control circuit for the machine of FIGS. 1 to 16.

To be noted that various electric interconnections between the elements are only shown in FIG. 17.

From the above it follows that the vertical plane of the wall 7 separates the washing compartment 3 from the casing 61, 62 which protrudes beyond this vertical plane only to such an extent that it is able to drive the washing drum 52. Thus the casing and the driving and control means mounted therein are not adversely affected by the heat developed in the washing compartment 3.

The operation of the above described washing machine is as follows.

At the start of a washing operation the cover front lid 60 is opened and a washing product is introduced in vat 1 which is afterwards filled with water either directly or via the water supply conduct 101 until the washing solution reaches a wanted level indicated by the float level indicating finger 41 which is visible through the window 42. By the opening of the cover front lid 60 the security make contact 201 is opened thus preventing the electric motor 114 from being energized (FIG. 17). The washing programme selection knob 78 is then turned into a position corresponding with a predetermined duration of a washing operation, whilst the dry/wash programme selection knob 113 is brought in the washing position. The dry programme selection knob 79 is preferably turned into its zero position but this is not a necessity. After laundry has been introduced in vat 1 the front lid 60 is again closed, thus producing the closure of security make contact 201.

When rotating the wash/dry selection knob 113 in the washing position against the action of spring 112, shutter member 95 is brought in the horizontal stable position shown in FIG. 5 wherein it closes opening 222 and brings the outlet pipe 98 via opening 27 in communication with the air channel 15 which at its top communicates with the atmosphere, as described above. The rotation of knob 113 also entails an upward movement of the control rod 110 which produces the opening of make contact 200 of switch 198 (FIG. 17) thus preventing the resistance 192 from being heated.

The rotation of the washing programme selection knob 78 in a position corresponding with a predetermined duration of a washing operation entails the rotation of the upper clutch member 137. The latter is thus brought in a predetermined angular position wherein the cam member 145 does not operate the movable armature 146 of microswitch 147 so that this armature 146 makes contact with the stationary contact member 219. This angular position is located at a predetermined angle from a final position wherein the cam member 145 will bring the movable armature 146 into contact with the stationary contact member 218.

The possible rotation of the drying programme selection knob 79 into its zero position opens make contact 182 of microswitch 181 (FIG. 17), but the position of this contact has no influence on the washing operation.

The movable armature 142 of microswitch 143 is in contact with one of the stationary contact members 216 and 217 so that when the mains 212 is switched-on the electric motor 114 is energized in an operating circuit comprising the mains 212, one of the motor windings 210, 211, one of the resistances 214, 215, armatures 142 and 146 of switches 143 and 147 respectively, and security make contact 201 of switch 199. Hereby the motor 114 and therefore also the drum 52 and the blower 183 are rotated in the one or other direction depending on the position of the armature 142 of the switch 143. This position is controlled by cam member 141 which alternately brings the movable armature 142 in contact with the stationary contact members 216 and 217 and thus changes the direction of rotation of the motor 114 and of the drum 52 and the blower 183 coupled therewith. Cam member 145 is displaced in a stepwise manner in clockwise direction (FIG. 14) and after a number of angular steps, i.e. after a predetermined duration corresponding to the washing programme selected by means of the knob 78, it brings the movable armature 146 of the microswitch 147 in a position wherein this armature 146 makes contact with the stationary contact member 218. Due to this the above operating circuit of the motor 114 is opened and this motor is nearly immediately stopped mainly due to the weight of the laundry in the drum.

During the washing operation air is sucked by the blower 183 via the air inlet openings 196. By the action of the smaller radial vanes 184 and the vanes 225 a cooling first air stream is made to flow over the motor 114 into the first housing part 227 and then radially expelled into the outlet pipe 98. Likewise, by the action of the larger radial vanes 185 a second air stream is led over the resistance 192 into the air inlet space 229 and the second housing part 228 and then expelled into the outlet pipe 98. From there both these air streams flow via opening 27 and air channel 15 upwardly and laterally into the atmosphere. Due to the opening 27 being relatively small the total air flow rate is relatively small so that the electric energy consumed by the blower during a washing operation is relatively small.

To be noted that although the motor is alternately rotated in opposite directions the air flow is in the same direction because the vanes 184 and 185 are radial vanes. It should also be noted that during the clockwise rotation of the cam member 145 the pins 148 and 141 thereof impart an angular motion to the rotation reversal member 155 as they successively come into contact with the lateral arm 156 of the latter member 155. However this has no influence on the relative position of the lower and upper clutch members 166 and 167 as the tooth 180 of the member 167 remains engaged in the groove 168 of the control arm 172.

After the washing operation is finished the washing solution is drained off whereafter the laundry is rinsed. To do this it is sufficient to bring the siphon tube 99 in the position shown and to admit water in the vat 1 through the water supply conduct 101 with a suitable flow rate. Indeed, when this is done the washing compartment 3 becomes gradually filled and the water level rises therein as well as in the siphon drain tube 99. When it reaches a sufficiently high level the siphon action is triggered and water is thereby drained off the washing compartment 3. By a suitable choice of the ratio of the diameters of the siphon tube 99 and of the water supply conduct 101 and by a suitable water flow rate in the latter conduit 101 the water level in the washing compartment 3 thereby gradually decreases. At a certain moment the siphon action therefore stops so that the water level will then again rise in the vat. In this way the washing compartment 3 is rinsed as long as water is admitted in the vat 1. After the rinsing operation and possibly after most of the water has been removed from the laundry the latter can be dried in the drum. To do this the selection knobs 79 and 113 are both turned in their drying position, the washing programme selection knob 78 being already in its zero position since the end of the washing operation.

By the rotation of the wash/dry selection knob 113 in its drying position the above mentioned shutter member 95 is rotated in its vertical position wherein it closes opening 27 and establishes a communication between outlet pipe 98 and the vat washing compartment 3 via opening 222, air conduct 16 and opening 24. Also make contact 200 (FIG. 17) of switch 198 is closed.

The clockwise rotation of the drying programme selection knob 79 in a position corresponding with a predetermined duration of a drying operation entails the rotation of the upper clutch member 167. The latter is thus brought in a predetermined angular position wherein the cam member 179 closes make contact 182 of switch 181 (FIG. 17). This angular position is located at a predetermined angle from a final position wherein the cam member 179 will open make contact 182.

The movable armature 142 of the microswitch 143 is in contact with one of the stationary contact members 216 and 217 and the movable armature 146 of the microswitch 147 is in contact with the stationary contact member 218 so that the motor 114 is again energized in an operating circuit comprising the mains 212, one of the resistances 214, 215, armatures 142 and 146 of switches 143 and 147 respectively and make contacts 200, 182 and 201 of switches 198, 181 and 199 respectively. Hereby the motor 114 and therefore also the drum 52 and the blower 183 are again alternately rotated in the one and other direction depending on the position of the armature 142 of the switch 143, this contact being alternately brought in contact with the stationary contact members 216 and 217 under control of the cam member 141. Also the electric resistance 192 is heated since a current flows through it via contacts 201, 182, 200 and 193. Air is sucked by the blower 183 via the air inlet openings 196 and by the action of the smaller radial vanes 184 and of the vanes 225 a cooling first air stream is made to flow over the motor 114 into the first housing part 227 and is then radially expelled into the outlet pipe 98. Likewise, by the action of the larger radial vanes 185 a second air stream is led over the thus heated resistance 192 into air inlet space 229 and second housing part 228 and is then expelled into the outlet pipe 98. From there both these air streams flow via the central air conduct 16 and openings 34 and 56 into the drum 52 and from there into the atmosphere through filter grid 64–66 mounted in opening 63 of the lid 60. Thus the motor 114 is continuously cooled by the cooling first air stream and is not adversely affected by the heated second air stream. Due to the opening 34 being relatively large when compared with opening 27 the air flow rate during a drying operation is much larger than during a washing operation.

From the above it follows that by the openings 27 and 34 and the shutter member 95 the flow rate of the air streams flowing through the outlet pipe 98 of the blower is regulated.

During the first portion of a full rotation of cam member 145 of the upper clutch member 137, i.e. as long as the cam member 145 makes contact with the movable armature 146 of the microswitch 147, the latter armature 146 remains in contact with the stationary contact member 218 so that the motor 114 remains energized in the last mentioned operating circuit. Hereby the laundry is dried by the heated air stream expelled by the blower 183. As soon as this cam member 145 leaves the movable armature 146 of microswitch 147 this armature 146 comes into contact with the stationary contact member 219 so that the motor 114 is then energized via the armature 146 and via make contact 201 of switch 199. However the heating resistance 192 remains connected to the mains 212 via the closed make contact 201, 182, 200 and 193 so that the laundry continues to be dried by heated air.

During the further rotation of the cam member 145 the pin 149 thereon pivots the rotation reversal member 155 in counterclockwise direction (FIG. 14) as it engages with the lateral arm 156 thereof. As a consequence the member 155 is rotated in counterclockwise direction and by the engagement of lip 158 of the lateral arm 157 of this member 155 with the control arm 172 the lower clutch member 166 is rotated in clockwise direction. By engagement of its teeth 170 to 173 with those of the upper clutch member 167 the latter is rotated over one tooth, in a clockwise direction, together with the selection knob 79, against the action of friction forces exerted by the washers 175, 176 and the screw 177. When at a certain moment the contact between the cam member 145 and the lateral arm 156 is broken the lower clutch member 166 is brought back into its rest position—its teeth slipping over those of the member 167—by the action of spring 164 whereas the upper clutch member 167 and the knob 79 both remain in the position attained, especially due to friction.

In an analogous way as just described also the pin 148 entails a rotation of the upper clutch member 167 and of the knob 79 in clockwise direction. This means that during each rotation of the cam member 145 the upper clutch member 167 is displaced over two teeth.

After a number of such angular displacements, i.e. after a number of rotations of the driving member 32, the lower clutch member 166 and therefore also the cam member 179 arrives in its initial position, shown in FIG. 14 wherein make contact 182 is open. Thus resistance 192 is no longer heated. At that moment one of the pins 148 and 149 has just moved beyond arm 156 so that the cam member 145 still has to perform a certain angular displacement before it causes armature 146 to be brought into contact with the stationary contact member 218. During this displacement and because the heating resistance 192 has been disconnected from the mains 212 the drying operation is performed with cold air. At the moment the armature 146 comes into contact with the stationary contact member 218 the electric motor 114 is no longer energized as the make contact 182 is open so that the movement of the various parts is then stopped, the drying operation being finished.

It should be noted that it is not absolutely mandatory to maintain the clutch mechanism 166, 167 and therefore the selection knob 79, substantially in their rest position (except for a small angular movement) during a washing operation. In this case the tooth 180 on the upper clutch member 167 is not required.

While the principles of the invention have been described above in connection with specific apparatus, it is to be clearly understood that this description is made only by way of example and not as a limitation on the scope of the invention.

We claim:

1. A laundry treating machine for performing both a washing and a drying operation, including a housing having a cover, a vat, a drum mounted in the vat for turning about an axis and a motor for turning the drum, comprising:

means for inducing a flow of air through two separate paths, one passing over the motor and the other circumventing the motor before combining with the air emerging from the first path for joint flow therewith to the exterior of the housing during the washing operation and into the drum during the drying operation; and means for heating the air in the second path at least during the drying operation.

2. The laundry treating machine of claim 1 wherein said inducing means includes a blower rotatably mounted to the motor.

3. The laundry treating machine of claim 2 further comprising means for regulating the rate of said flow of air to provide a smaller flow during the washing operation than during the drying operation.

4. The laundry treating machine of claim 3 wherein said inducing means further includes means for selectively directing said joint flow to the exterior of the housing and to the vat, including an outlet pipe having two end portions, one of said end portions having an opening which is directed toward said blower and the other of said end portions having two openings, one of which is directed to the vat and the second of which is directed to the exterior of the housing, and wherein said regulating means includes a shutter member positioned in said outlet pipe for movement between a first position in which it directs said joint flow to the vat during the drying operation, and a second position in which it directs said joint flow to the exterior of the housing during the washing operation.

5. The laundry treating machine according to claim 4 wherein said shutter member is a bistable rotatable member.

6. The laundry treating machine according to claim 4 further comprising an electrical system including an electrical source and a contact arrangement interposed in said electrical system between said electrical source and said heating means, and means coupled to said shutter member and said contact arrangement for jointly moving said shutter member into said second position and causing said contact arrangement to disconnect said heating means from said electrical source during the washing operation and for jointly moving said shutter member into said first position and causing said contact arrangement to connect said heating means with said electrical source during the drying operation.

7. The laundry treating machine according to claim 6 wherein the drum has an opening therein, the cover includes a lid positioned over the drum, and a casing including air inlet openings and accommodating the motor, said blower, said heating means, and a housing for said blower having an opening directed toward said outlet pipe and wherein said blower includes a wheel portion and a first and second set of vanes mounted on said wheel portion, said blower being arranged in said blower housing such that said flow is separated into said first and second paths, said first set of vanes causing air to move in said first path from said air inlet openings and over the motor to said outlet pipe, and said second set of vanes causing air to move in said second path from said air inlet openings and over said heating means to said outlet pipe.

8. The laundry treating machine according to claim 7 wherein said second set of vanes has a larger surface area than said first set of vanes.

9. The laundry treating machine according to claim 7 wherein the cover further includes an air inlet space which communicates with said heating means at one end and with said outlet pipe at the other end and through which said second path is directed, said air inlet space being separated from the other parts of the cover.

10. The laundry treating machine according to claim 7 wherein the housing has a front section in which the vat is situated, a rear section and a partition wall separating said front and said rear sections, and wherein said casing has a first portion supported by said rear section and a second portion provided with said air inlet openings.

11. The laundry treating machine according to claim 10 further comprising an air channel which communicates with the second of said openings of said outlet pipe at one end and with the atmosphere at the other end, and wherein said casing includes a cover which is secured to said rear section of the vat and which, together with a portion of said air channel, forms said outlet pipe.

12. The laundry treating machine according to claim 10 wherein said rear section of the vat further includes two outer reinforcing columns for supporting said first portion of said casing on part of their upper edges.

13. The laundry treating machine according to claim 12 wherein at least a portion of said air inlet openings is located above at least one of said columns.

14. The laundry treating machine according to claim 10 wherein said partition wall is in a substantially vertical plane.

15. The laundry treating machine according to claim 14, wherein said casing protrudes beyond said vertical plane only to such an extent as to be able to turn the drum.

16. The laundry treating machine according to claim 4 further comprising an air conduit which communicates with the first of said openings of said outlet pipe at one end and with the vat at the other end for directing said flow during the drying operation, and an air channel which communicates with the second of said openings of said outlet pipe at one end and with the atmosphere at the other end for directing said flow during the washing operation.

17. The laundry treating machine as claimed in claim 2 further comprising a shaft extending longitudinally through the motor on which said blower is mounted, said shaft being substantially parallel to the axis of and in substantially the same vertical plane as the drum.

18. The laundry treating machine according to claim 17, wherein the drum is cylindrical and is mounted at a distance from a bottom portion of the vat, the bottom portion being constituted by a part of a cylinder which has a diameter larger than that of the drum and the axes of the drum and of said cylinder being parallel and located in a same vertical plane.

19. The laundry treating machine according to claim 1 further comprising:

a rotatable driving member interposed between and mounted in driving relationship with the motor and the drum and operable for rotation of the drum and for controlling the timing of the washing and drying operations;

rotational speed reduction arrangement for reducing the rotation speed of said rotatable driving member, said arrangement including:

a first speed reduction device having a first one-way clutch mechanism with a first rotatable input member and a first rotatable output member, and a first restoring member, said rotatable driving member when making a predetermined rotation in a predetermined direction imposes on said first input member an angular displacement from an initial position over a fraction of said predetermined rotation and in an opposite direction, said first output member being thereby angularly displaced in said opposite direction by said first input member, and said first restoring member being then able to rotate said first input member back into said initial position, said first input member thereby remaining in the position previously attained, and a second speed reduction device including a second input member and a second output member, and a second restoring member, said second input member being driven from said second output member of said first speed reduction device.

20. The laundry treating machine according to claim 19 further comprising a rotatable rotation reversal device through which said first output member is coupled with said second input member in such a manner that, when said first output member makes a predetermined rotation in said opposite direction, said first output member imposes said second input member and via said rotation reversal member at least one angular displacement from an initial position over a fraction of said predetermined rotation and in said predetermined direction, said second output member being thereby angularly displaced in said predetermined direction by said first input member, and said second restoring member being then able to rotate said second input member back into said initial position, said second output member thereby remaining in the previously attained position.

21. The laundry treating machine according to claim 20, wherein said rotatable rotation reversal device includes a rotatable arm having two ends, one of said ends being situated in the path traversed by said first output member, said second input member being situated in the path traversed by the other of said ends of said rotatable arm.

22. The laundry treating machine according to claim 20 wherein said predetermined rotation includes two successive ones of said angular displacements from said first output member to said second input member.

23. The laundry treating machine according to claim 19 wherein said rotatable driving member is rotatable in said opposite direction and constitutes said first restoring member.

24. The laundry treating machine according to claim 19, wherein said second restoring member includes spring means.

25. The laundry treating machine according to claim 24, wherein said second speed reduction device includes first and second teeth provided on said second input and said second output members respectively, the latter being rotatably mounted such that during an angular displacement, said first and second teeth are subjected to friction forces and that for an angular displacement of said second input member in said predetermined direction said first teeth cooperate with said second teeth to displace said second output member against the action of said friction forces, and for an angular displacement of said second input member in said opposite direction by said spring means, said second output member remains stationary due to the action of said friction forces, said first teeth thereby slipping over said second teeth.

26. The laundry treating machine according to claim 25, wherein said second input member additionally includes a substantially annular body, having an upper surface provided with said first teeth, a vertical peg around which said second input member is mounted, said second output member also including a ringshaped lower part having a bottom surface provided with said second teeth, and a dome-shaped upper part, said second input member being also mounted around said vertical peg and above said second input member; and further comprising second spring means connected between said second output member and a top surface of said vertical peg for exerting a downward pressure on said second output member to prevent the rotation thereof, and third spring means for exerting an upward pressure on said second input member to prevent the rotation thereof.

27. The laundry treating machine according to claim 26, wherein said second spring means includes a spring washer which is secured on said top surface of said dome-shaped part by a washer and a screw mounted around said vertical peg.

28. The laundry treating machine according to claim 26 wherein said third spring means includes a helical spring, the upper end of which is housed in a first circular groove in the bottom part of said second input member and the lower end of which is housed in a second circular groove provided in a peripheral shoulder of said vertical peg.

29. The laundry treating machine according to claim 1 further comprising a washing operation timing device and a drying operation timing device, said drying operation timing device being driven through said washing operation timing device.

30. The laundry treating machine according to claim 29 wherein said washing operation timing device includes a first speed reduction device and a change-over contact controlled by a first output member which can be manually brought in a first position in which said change-over contact is in a first position, and in any one of a number of selectable second positions in which said change-over contact is in a second position, and that said drying operation timing mechanism includes a second speed reduction device and a second contact arrangement which is controlled by a second output member which can be be manually brought in a third position in which said second contact arrangement is in a first open position and in any of a number of selectable fourth position in which said second contact arrangement is in a second closed position and further comprising a driving member constituted by a motor coupled across the poles of an electric source in series with a parallel circuit with a first branch including said change-over contact in said first position in series with said second contact arrangement and with a second branch including said change-over contact in said second position.

31. The laundry treating machine according to claim 30, wherein a contact arrangement rod is also included in said first branch and is connected in series with said second contact arrangement and said heating means across said electrical source.

32. The laundry treating machine according to claim 30, wherein said change-over contact and said second contact arrangement assume said first and second positions at the start of a washing operation respectively and said second and first positions at the start of the drying operation respectively and that said first and second speed reduction devices and said change-over contact and said second contact arrangement are so positioned with respect to each other that when said second output member brings said second contact arrangement back into said first position said output member of said first speed reduction device still has to perform a certain angular displacement before bringing said change-over contact back into said first position.

33. The laundry treating machine according to claim 1, wherein the cover includes a lid positioned over the drum, and further comprising a security device which is controlled by said lid in such a way that the operation of the motor is prevented when said lid is in other than a closed position and wherein the motor is enabled when said lid is in a closed position.

34. The laundry treating machine according to claim 33, further comprising an electrical source connected to the motor, and wherein said security device includes a contact coupling the motor to said electrical source, a rotatable lever arm which controls said contact, and wherein said lid includes hinges for hingedly and removably connecting said lid to said casing, at least one of said hinges including a pivot pin on said lid, a stud provided in an end of said lever arm, said pivot pin being rotatably mounted in a hole of said stud, spring means connected to said lever arm for urging rotation thereof in a predetermined direction, said end being rotatably mounted in a lateral wall of said casing and the cross-sections of said hole and of said pivot pin being such that a rotation of said lid in a direction opposite to said predetermined direction entails a rotation of said lever arm in said opposite direction.

35. The laundry treating machine according to claim 1 further comprising a float compartment communicating with the vat and including a float, a rod mounted at one end of the float and a level indicating finger provided at the other end of the rod and protruding through an opening in a wall of the vat.

36. The laundry treating machine according to claim 35 further comprising a window clipped in apertures of the vat wall for closing said opening in said wall of said vat.

37. The laundry treating machine according to claim 1, further comprising a supply conduct coupled to the vat for supplying a rinsing liquid, and a siphon drain tube coupled to the vat, said tube having a larger cross-section than said supply conduct.

38. The laundry treating machine according to claim 37 wherein the diameter of said siphon drain tube is about twice the diameter of said supply conduct.

39. The laundry treating machine according to claim 37, wherein said siphon drain tube has an inlet which is close to the bottom of the vat, and an outlet which is below said inlet.

* * * * *